US009302135B1

(12) United States Patent
Dallmann et al.

(10) Patent No.: US 9,302,135 B1
(45) Date of Patent: Apr. 5, 2016

(54) MULTI-ZONE TRAMPOLINE

(71) Applicant: Defy Gravity, LLC, La Vista, NE (US)

(72) Inventors: Brandon Dallmann, Hickman, NE (US); Dean Prochnow, Lincoln, NE (US); Brett Shunkwiler, Eagle, NE (US); Kyle Shunkwiler, Lincoln, NE (US)

(73) Assignee: Defy Gravity, LLC, La Vista, NE (US)

( * ) Notice: Subject to any disclaimer, the term of this patent is extended or adjusted under 35 U.S.C. 154(b) by 12 days.

(21) Appl. No.: 13/763,993

(22) Filed: Feb. 11, 2013

Related U.S. Application Data

(60) Provisional application No. 61/597,235, filed on Feb. 10, 2012.

(51) Int. Cl.
*A63B 5/11* (2006.01)

(52) U.S. Cl.
CPC ..... *A63B 5/11* (2013.01)

(58) Field of Classification Search
CPC .. A63B 5/11; A63B 2071/009; A63B 71/023; A63B 26/00
USPC ..... 482/23, 27–29; 135/119, 125, 136; 52/220.1, 686, 687; 472/135; 267/182
See application file for complete search history.

(56) References Cited

U.S. PATENT DOCUMENTS

| | | | | | |
|---|---|---|---|---|---|
| 3,233,895 | A * | 2/1966 | Grelle et al. | 482/27 |
| 4,068,404 | A * | 1/1978 | Sheldon | 47/22.1 |
| 4,096,669 | A * | 6/1978 | Pabst | 52/63 |
| 5,624,122 | A * | 4/1997 | Winkelhorn | 473/471 |
| 6,036,620 | A * | 3/2000 | Yang | 482/27 |
| 8,657,696 | B1 * | 2/2014 | Gurley | 472/92 |
| 8,668,190 | B1 * | 3/2014 | Heruska et al. | 267/182 |
| 2004/0206030 | A1 * | 10/2004 | Juedes et al. | 52/384 |
| 2006/0032179 | A1 * | 2/2006 | Lee et al. | 52/686 |
| 2006/0194674 | A1 * | 8/2006 | Hickey | 482/27 |
| 2007/0010374 | A1 * | 1/2007 | Widich | 482/27 |
| 2011/0287899 | A1 * | 11/2011 | West | 482/27 |

* cited by examiner

*Primary Examiner* — Loan H Thanh
*Assistant Examiner* — Andrew S Lo
(74) *Attorney, Agent, or Firm* — David H. Milligan PC LLO

(57) ABSTRACT

A multi zone trampoline is disclosed. The trampoline includes a frame, including a plurality of first vertical members, a plurality of first horizontal members coupled to the first vertical members and generally defining a perimeter of a planar jumping surface, a plurality of second vertical members, the second vertical members having a height greater than the first vertical members, a plurality of second horizontal members coupled to the second vertical members and at least partially defining a second perimeter greater than the perimeter of the planar jump surface, and a plurality of caps positioned at the top of at least a portion of the first vertical members, the caps configured to accommodate cables running in perpendicular directions while preventing direct contact between perpendicular cables. A plurality of segments are arranged to form the jump surface, the planar segments being coupled to one or more of the cables.

2 Claims, 5 Drawing Sheets

MULTI-ZONE TRAMPOLINE

BACKGROUND

Large, multi-user trampolines have been adapted or entertainment and exercise purposes in the past. However, many of the designs for such systems have a number of limitations. These include complicated construction and positioning of cables and other coving components where they can wear against one another. Accordingly, there is a need for a multi-user trampoline configured to reduce wear, and provide simplified, modular design and construction to fit a pre constructed space.

SUMMARY

A multi zone trampoline is disclosed. The trampoline includes a frame, including a plurality of first vertical members, a plurality of first horizontal members coupled to the first vertical members and generally defining a perimeter of a planar jumping surface, a plurality of second vertical members, the second vertical members having a height greater than the first vertical members, a plurality of second horizontal members coupled to the second vertical members and at least partially defining a second perimeter greater than the perimeter of the planar jump surface, and a plurality of caps positioned at the top of at least a portion of the first vertical members, the caps configured to accommodate cables running in perpendicular directions while preventing direct contact between perpendicular cables. A plurality of segments are arranged to form the jump surface, the planar segments being coupled to one or more of the cables.

BRIEF DESCRIPTION OF THE DRAWINGS

FIG. 8 is a perspective view of a dual layer, multi-user, multi-zone trampoline.

DETAILED DESCRIPTION

Figure 1:
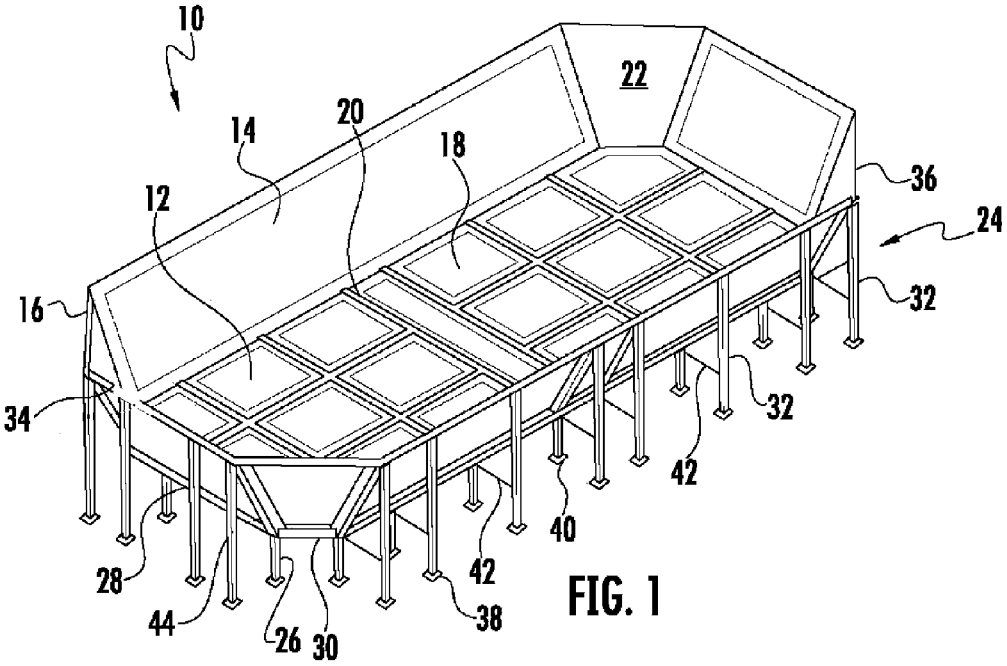
FIG. 1 is a perspective view of an assembled multi-user, multi-zone trampoline.

A multi-user, multi-zone trampoline is disclosed. Referring to FIG. 1, the trampoline 10 includes a jump surface 12 at least partially enclosed about a perimeter by side panels 14 and 16. Jump surface 12 comprises multiple smaller, planar segments 18. Each segment 18 comprises a resilient fabric suitable to use in trampolines and is attached by springs to cables running under pads 20. The cables and segments 18 may be arranged in a grid-like fashion. An opening 22, is provided to allow users entry onto jump surface 12. Opening 22 is shown in a corner, but could be positioned elsewhere as well.

Jump surface 12 and side panels 14 and 16 are supported by frame 24. Frame 24 includes a variety of generally straight members coupled together. First vertical members 26 are positioned to support first horizontal members 28 about a perimeter of jump surface 12. In some embodiments, angled members 30 may be used to partially define the perimeter about jump surface 12. The segments 18 along the outside of jump surface 12 may generally be attached along one side to one or more of first horizontal members 28.

Second vertical members 32 extend from the floor to a height above jump surface 12. Second vertical members 32 are positioned to support second horizontal members 34 and angled members 36 to provide a second perimeter. The second perimeter is positioned above jump surface 12 and extends outside the perimeter of jump surface 12. The allows for the mounting of side panels 14 and 16 such that they extend at an angle Baseplates 38 and 40 may be used to secure vertical members 26 and 32 to a floor, respectively. Various configurations of bracing members such as bracing member 42 may be used to provide a rigid frame.

Figure 2:
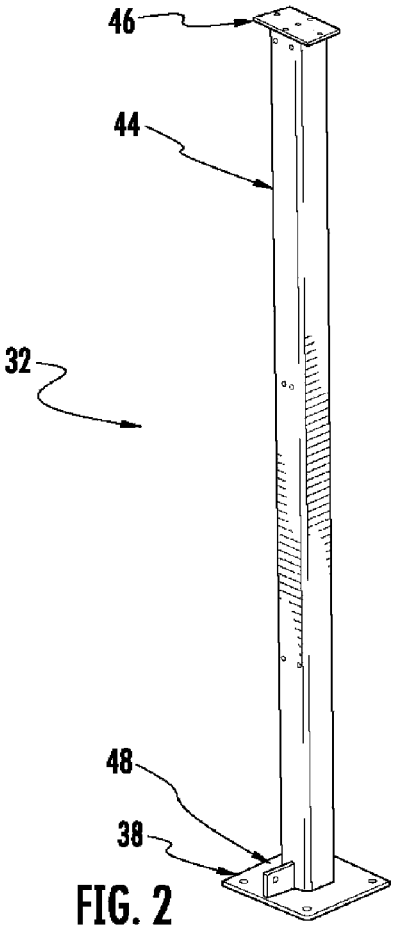
FIG. 2 is a perspective view of a vertical frame member.

Referring to FIG. 2, second vertical member 32 is shown in greater detail. Second vertical member 32 includes a main body 44 shown as a hollow rectangular tube. In other embodiments, main body 44 could be solid or of a different cross-section. Main body 44 extends vertically from a baseplate 38 to a top plate 46. Baseplate includes a plurality of apertures for anchoring into a floor. Plate 48 is provided at baseplate 38 and may be coupled to both baseplate 38 and main body 44 by welding or other appropriate means. An aperture is provided in plate 38 may be provided for anchoring one or more of the cables used to suspend jump surface 12 show in FIG. 1. Top plate 46 may be provided with apertures to facilitate fastening to horizontal members 34 and/or 36.

Figure 3:
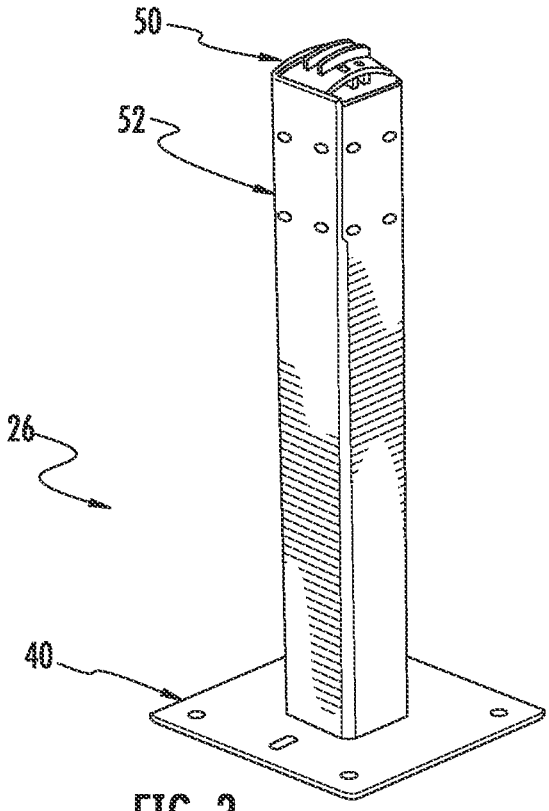
FIG. 3 is a perspective view of a vertical frame member.
Figure 4:
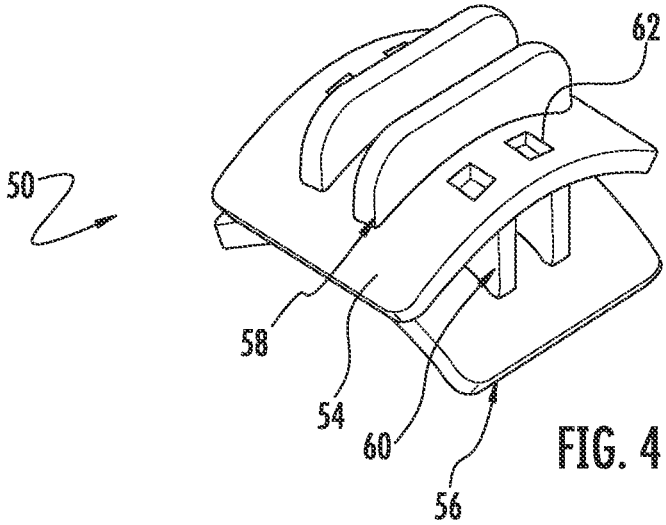
FIG. 4 is a perspective view of a vertical frame member cap.
Figure 5:
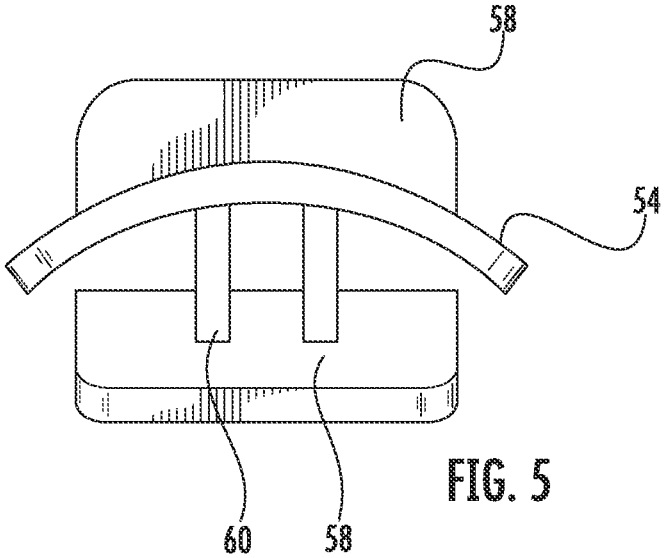
FIG. 5 is a side elevation view of a vertical frame member cap.

Referring to FIG. 3, first vertical member 26 includes main body 52 that extends from baseplate 40 to cap 50. Cap 50 is configured to allow the passage of two perpendicular steel cables, one above the other. In more detail, as shown in FIGS. 4 and 5, cap 50 includes a top cable guide 54 and a bottom cable guide 56. These components may be identical for ease of manufacture. Top cable guide 54 includes projections 58 which partially define a channel of suitable width to accommodate a cable of desired thickness. Similarly, bottom cable guide 56 includes projections 60 which partially define a channel configured to accommodate a cable of desired thickness running perpendicular to the channel partially defined by projections 58. Additionally, apertures 62 may be provided in top cable guide 54 in positions roughly corresponding to the top surfaces of projections 60 from bottom cable guide 56. These apertures may provide welding points for permanently coupling top cable guide 54 to bottom cable guide 56 to form cap 50. Alternatively, apertures 62 may allow for staking, fastening or other coupling means. As shown most clearly in FIG. 5, edges of the cable guides 54 and 56 may extend beyond one another to provide welding contacts for coupling cap 50 to main body 52. Cable guides 54 and 56 are shown as curved to allow for the guided cable to be directed downward towards an anchor point, such as the aperture in plate 38 of second vertical member 32.

Figure 6:
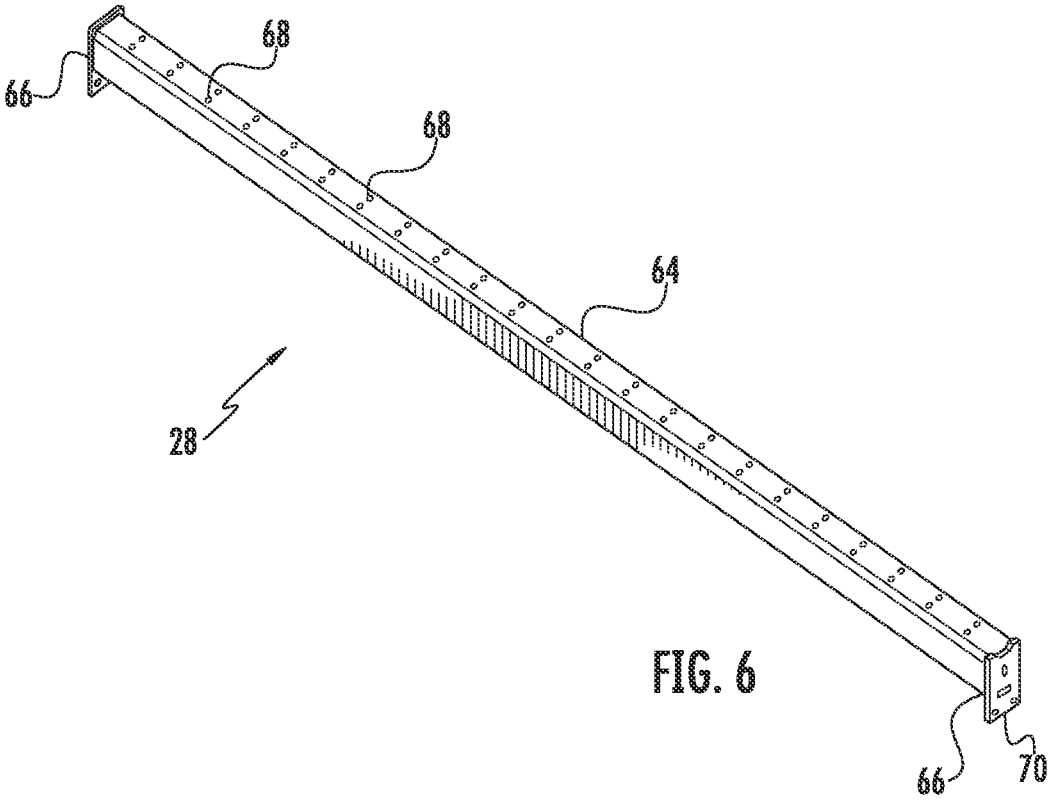
FIG. 6 is a perspective view of a horizontal frame member.

The various horizontal members may be of a configuration general like that shown in FIG. 6. As with the other frame members, horizontal member 28 may include a main body 64 constructed of hollow rectangular tubing. End plates 66 may be provided for coupling horizontal member 28 to one or more vertical members, or to another horizontal member. Apertures 68 are provided for coupling springs for supporting segments 18 along one side. End plates 66 may include a flange portion 70 extending beyond the cross-sectional perimeter of main body 64. Apertures may be provided in flange portion 70 to facilitate fastening horizontal member 28 to a vertical member or another horizontal member. Alternatively, horizontal member 26 may be anchored to a vertical surface in certain embodiments.

Figure 7:
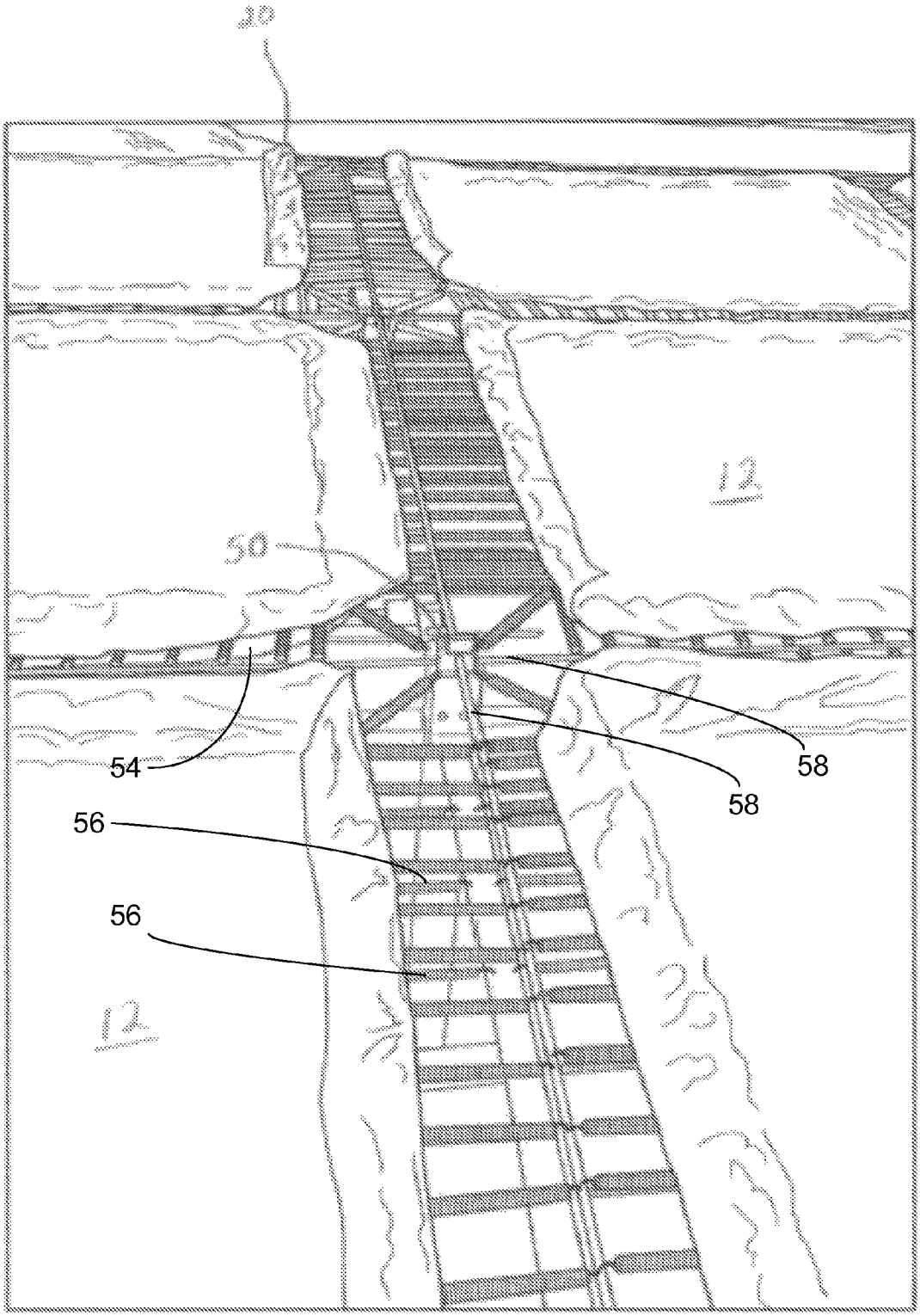
FIG. 7 is a side, perspective view of a dual layer, multi-user, multi-zone trampoline.
Figure 9:
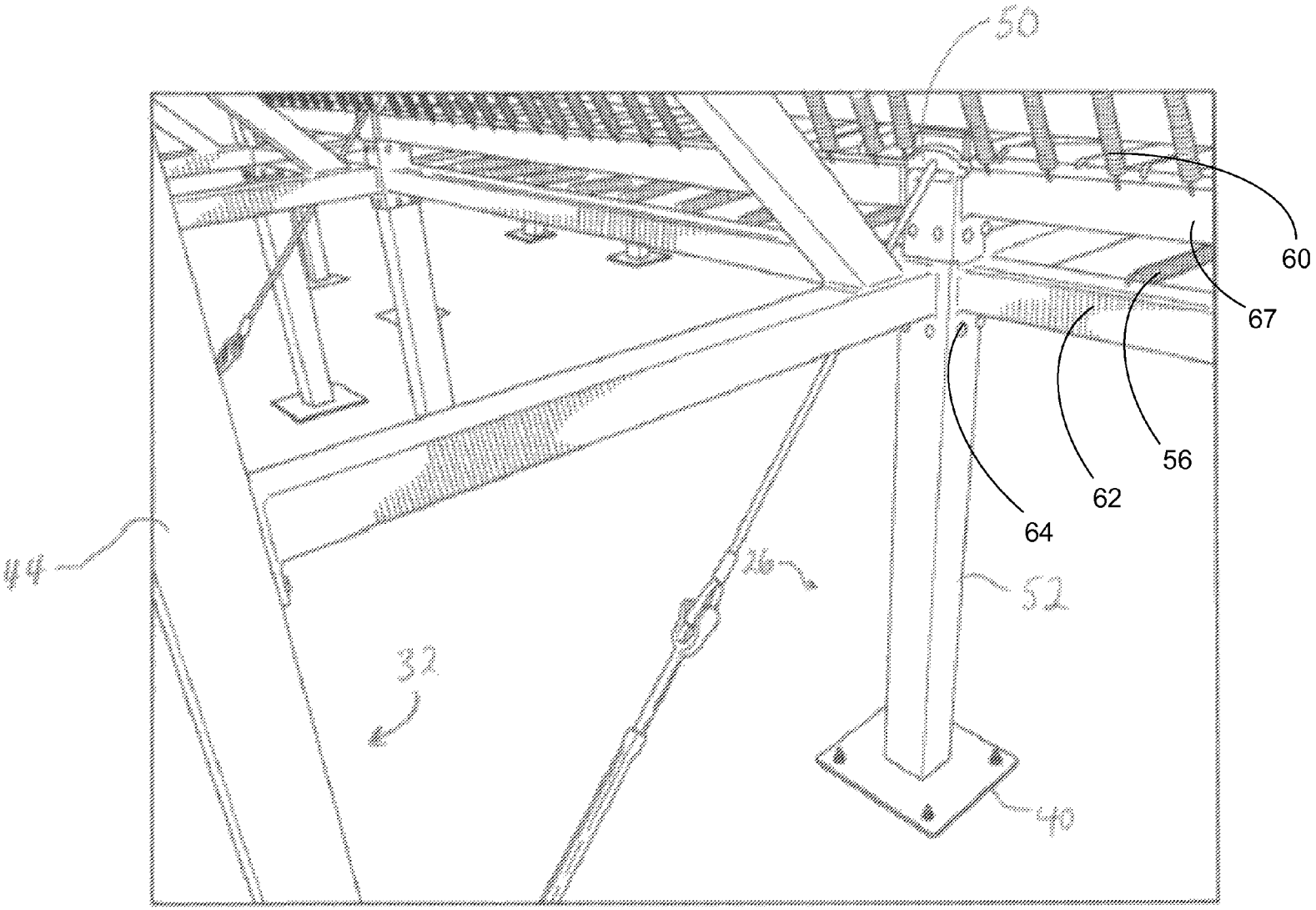

FIGS. 7 and 8 show a constructed multi-layer trampoline. In these images, a first lower jump surface 54 is positioned below a second jump surface 12. Both jump surfaces are divided into segments. The lower surface 54 is framed by a grid of lower horizontal members 62 which are attached to the vertical members 52 via side apertures 64. As further shown, the lower level horizontal members 62 further include openings to link with a number of springs 56 which support the lower jump surface 54. Preferably, the vertical members 52 extend from baseplates anchored to the floor at each intersection and the upper horizontal members 67 and the lower horizontal members 62 are coupled thereto.

As further shown in FIGS. 7 and 8, the second jump surface 12 includes segments coupled to a grid of steel cables 58. The intersection of two perpendicular cables corresponds to a cap of a vertical member 52. This prevents rubbing of cables against one another when the trampoline is in use. Springs are used to couple the segments to the steel cables along the segment edges, and to couple the segment corners to the vertical members. Along the outermost perimeter of the second jump surface 12, springs 60 may be used to couple the segments to horizontal members. The multiple layers allow a user to gain greater height by deflecting the top layer to a point that the top layer comes into contact with the lower layer. The physical properties of the material used in the two layers may be different, such as, for example, the lower layer may be less deformable. In such cases a lesser displacement of the lower lay would correspond to a higher amount of stored energy than for the upper layer.

Although a few exemplary embodiments of the present invention have been shown and described, the present invention is not limited to the described exemplary embodiments. Instead, it would be appreciated by those skilled in the art that changes may be made to these exemplary embodiments without departing from the principles and spirit of the invention, the scope of which is defined by the claims and their equivalents.

The terminology used in the description of the invention herein is for the purpose of describing particular embodiments only and is not intended to be limiting of the invention. As used in the description of the embodiments of the invention and the appended claims, the singular forms "a", "an" and "the" are intended to include the plural forms as well, unless the context clearly indicates otherwise.

Unless otherwise defined, all technical and scientific terms used herein have the same meaning as commonly understood by one of ordinary skill in the art to which this invention belongs. All publications, patent applications, patents, and other references mentioned herein are incorporated by reference in their entirety.

It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that relative terms are intended to encompass different orientations of the device in addition to the orientation depicted in the Figures.

Moreover, it will be understood that although the terms first and second are used herein to describe various features, elements, regions, layers and/or sections, these features, elements, regions, layers and/or sections should not be limited by these terms. These terms are only used to distinguish one feature, element, region, layer or section from another feature, element, region, layer or section. Thus, a first feature, element, region, layer or section discussed below could be termed a second feature, element, region, layer or section, and similarly, a second without departing from the teachings of the present invention.

It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Further, as used herein the term "plurality" refers to at least two elements. Additionally, like numbers refer to like elements throughout.

Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow. The scope of the disclosure is not intended to be limited to the embodiments shown herein, but is to be accorded the full scope consistent with the claims, wherein reference to an element in the singular is not intended to mean "one and only one" unless specifically so stated, but rather "one or more." All structural and functional equivalents to the elements of the various embodiments described throughout this disclosure that are known or later come to be known to those of ordinary skill in the art are expressly incorporated herein by reference and are intended to be encompassed by the claims.

What is claimed is:

1. A trampoline comprising:

a plurality of first vertical members, wherein the plurality of first vertical members comprise a top and a plurality of side apertures; wherein the side apertures are configured to attach to at least one of a plurality of upper level horizontal members and at least one of a plurality of lower level horizontal members; wherein, the lower level horizontal members are configured to attach to a plurality of springs for supporting a lower jumping surface; further wherein, the upper level horizontal members are configured to attach to a plurality of springs for supporting an upper jumping surface;

wherein, the plurality of upper level horizontal members coupled to the first vertical members generally define a first perimeter of a jumping area, wherein the jumping area is comprised of the upper jumping surface and the lower jumping surface;

a plurality of second vertical members, the second vertical members having a height greater than the first vertical members;

a plurality of second horizontal members coupled to the second vertical members and at least partially defining a second perimeter, wherein the second perimeter is greater than the first perimeter; and at least one cap, wherein the cap is positioned on the top of a first vertical member, wherein the cap comprises:

a lower platform, wherein the lower platform comprises a substantially rectangular element which is curved to form a first lower concave surface and a first upper convex surface, wherein said lower concave surface is secured to the first vertical member, further wherein said upper convex surface comprises a first plurality of raised projections; and an upper platform, wherein the upper platform comprises a substantially rectangular element which is curved to form a second lower concave surface and a second upper convex surface, wherein said second lower concave surface is secured to a raised projection extending from the lower platform, further wherein said second upper convex surface comprises a second plurality of raised projections;

wherein the first plurality of raised projections are configured to receive a first cable for providing tension oriented in a first direction; and further wherein the second plurality of raised projections are configured to receive a second cable for providing tension which is oriented in a second direction, wherein the second direction is substantially perpendicular to the first direction.

2. The trampoline of claim 1, further comprising a plurality of angled segments, wherein the angled segments extend from the perimeter of the jumping area to the second horizontal members.

* * * * *